US008069677B2

(12) United States Patent
Faka

(10) Patent No.: US 8,069,677 B2
(45) Date of Patent: Dec. 6, 2011

(54) REGASIFICATION OF LNG USING AMBIENT AIR AND SUPPLEMENTAL HEAT

(75) Inventor: Solomon Aladja Faka, Woodland Hills, CA (US)

(73) Assignee: Woodside Energy Ltd., Perth (AU)

( * ) Notice: Subject to any disclaimer, the term of this patent is extended or adjusted under 35 U.S.C. 154(b) by 1298 days.

(21) Appl. No.: 11/675,651

(22) Filed: Feb. 16, 2007

(65) Prior Publication Data

US 2007/0214806 A1 Sep. 20, 2007

Related U.S. Application Data

(60) Provisional application No. 60/782,282, filed on Mar. 15, 2006.

(51) Int. Cl.
*F17C 9/02* (2006.01)

(52) U.S. Cl. ..... 62/50.2; 62/150; 62/151; 62/156; 62/276

(58) Field of Classification Search ..... 62/50.2, 62/276, 150, 151, 156
See application file for complete search history.

(56) References Cited

U.S. PATENT DOCUMENTS

| | | | | |
|---|---|---|---|---|
| 2,795,937 | A | 6/1957 | Sattler et al. | |
| 2,833,121 | A * | 5/1958 | Dorf | 62/50.2 |
| 2,903,860 | A | 9/1959 | Brown | |
| 2,938,259 | A | 5/1960 | Cobb et al. | |
| 2,940,268 | A | 6/1960 | Morrison | |
| 2,975,607 | A | 3/1961 | Bodle | |
| 3,001,379 | A | 9/1961 | Fukuzawa et al. | |
| 3,154,928 | A | 11/1964 | Harmens | |
| 3,350,876 | A | 11/1967 | Johnson | |
| 3,365,898 | A | 1/1968 | Van Kleef | |
| 3,421,574 | A | 1/1969 | Kals | |
| 3,435,623 | A * | 4/1969 | Tyree, Jr. | 62/50.2 |
| 3,438,216 | A | 4/1969 | Smith | |
| 3,590,407 | A | 7/1971 | Bratianu | |
| 3,720,057 | A | 3/1973 | Arenson | |
| 3,768,271 | A | 10/1973 | Denis | |
| 3,857,245 | A | 12/1974 | Jones | |
| 3,864,918 | A | 2/1975 | Lorenz | |

(Continued)

FOREIGN PATENT DOCUMENTS

DE 3035349 4/1982

(Continued)

OTHER PUBLICATIONS

Stone, et al. "Offshore LNG Loading Problem Solved", Gastech, 2000.

(Continued)

*Primary Examiner* — Cheryl J Tyler
*Assistant Examiner* — John Pettitt
(74) *Attorney, Agent, or Firm* — Edell, Shapiro & Finnan, LLC

(57) ABSTRACT

Liquefied natural gas is regasified to form natural gas, including circulation of an intermediate fluid between a vaporizer and an ambient air heater, where the intermediate fluid is warmed by exchanging heat with the ambient air as the intermediate fluid passes through the ambient air heater, and the intermediate fluid is cooled by exchanging heat with LNG as the intermediate fluid passes through the vaporizer. The ambient air heater is subjected to a defrosting cycle by intermittently regulating the temperature of the intermediate fluid fed to the ambient air heater to a temperature greater than zero degrees Celsius using a source of supplemental heat.

18 Claims, 5 Drawing Sheets

U.S. PATENT DOCUMENTS 3,986,340 A 10/1976 Bivins, Jr.
4,033,135 A 7/1977 Mandrin
4,036,028 A 7/1977 Mandrin
4,045,972 A * 9/1977 Tyree, Jr. ..... 62/156
4,170,115 A 10/1979 Ooka et al.
4,197,712 A 4/1980 Zwick et al.
4,224,802 A 9/1980 Ooka
4,231,226 A 11/1980 Griepentrog
4,331,129 A 5/1982 Hong et al.
4,399,660 A 8/1983 Vogler, Jr. et al.
4,417,878 A 11/1983 Koren
4,420,942 A 12/1983 Davis et al.
4,519,213 A 5/1985 Brigham et al.
4,813,632 A 3/1989 Woodhouse
4,819,454 A 4/1989 Brigham et al.
4,881,495 A 11/1989 Tornare et al.
4,995,234 A 2/1991 Kooy et al.
5,095,709 A 3/1992 Billiot
5,099,779 A 3/1992 Kawaichi et al.
5,129,848 A 7/1992 Etheridge et al.
5,147,005 A 9/1992 Haeggstrom
5,240,466 A 8/1993 Bauer et al.
5,251,452 A 10/1993 Wieder
5,292,271 A 3/1994 Boatman et al.
5,295,350 A 3/1994 Child et al.
5,306,186 A 4/1994 Boatman
5,316,509 A 5/1994 Boatman et al.
5,351,487 A 10/1994 Abdelmalek
5,356,321 A 10/1994 Boatman et al.
5,372,531 A 12/1994 Boatman et al.
5,375,582 A 12/1994 Wimer
5,394,686 A 3/1995 Child et al.
5,400,588 A 3/1995 Yamane et al.
5,456,622 A 10/1995 Breivik et al.
5,457,951 A 10/1995 Johnson et al.
5,492,075 A 2/1996 Lerstad et al.
5,529,239 A 6/1996 Anttila et al.
5,545,065 A 8/1996 Breivik et al.
5,564,957 A 10/1996 Breivik et al.
5,584,607 A 12/1996 de Baan
5,727,492 A 3/1998 Cuneo et al.
5,762,119 A 6/1998 Platz et al.
5,819,542 A 10/1998 Christiansen et al.
5,820,429 A 10/1998 Smedal et al.
5,878,814 A 3/1999 Breivik et al.
5,921,090 A 7/1999 Jurewicz et al.
5,944,840 A 8/1999 Lever
6,003,603 A 12/1999 Breivik et al.
6,085,528 A 7/2000 Woodall et al.
6,089,022 A 7/2000 Zednik et al.
6,094,937 A 8/2000 Paurola et al.
6,109,830 A 8/2000 de Baan
6,221,276 B1 * 4/2001 Sarin ..... 252/76
6,244,920 B1 6/2001 de Baan
6,263,818 B1 7/2001 Dietens et al.
6,298,671 B1 10/2001 Kennelley et al.
6,354,376 B1 3/2002 De Baan
6,367,258 B1 4/2002 Wen et al.
6,374,591 B1 4/2002 Johnson et al.
6,378,722 B1 4/2002 Dhellemmes
6,517,290 B1 2/2003 Poldervaart
6,546,739 B2 4/2003 Frimm et al.
6,571,548 B1 6/2003 Bronicki et al.
6,581,368 B2 6/2003 Utamura
6,598,401 B1 7/2003 Utamura
6,598,408 B1 7/2003 Nierenberg
6,609,360 B2 8/2003 Utamura
6,622,492 B1 9/2003 Eyermann
6,623,043 B1 9/2003 Pollack
6,637,479 B1 10/2003 Eide et al.
6,644,041 B1 11/2003 Eyermann
6,688,114 B2 2/2004 Nierenberg
6,692,192 B2 2/2004 Poldervaart
6,811,355 B2 11/2004 Poldervaart
6,889,522 B2 5/2005 Prible et al.
7,219,502 B2 5/2007 Nirenberg
7,287,389 B2 10/2007 Feger
7,293,600 B2 11/2007 Nirenberg
2002/0047267 A1 4/2002 Zimron et al.
2002/0073619 A1 6/2002 Perkins et al.
2002/0124575 A1 9/2002 Pant et al.
2002/0174662 A1 11/2002 Frimm et al.
2003/0005698 A1 1/2003 Keller
2003/0226487 A1 12/2003 Boatman
2004/0006966 A1 * 1/2004 Hallman et al. ..... 60/39.093
2004/0025772 A1 2/2004 Boatman
2004/0094082 A1 5/2004 Boatman et al.
2004/0182090 A1 9/2004 Feger
2005/0061002 A1 3/2005 Nierenberg
2005/0120723 A1 6/2005 Baudat
2005/0217314 A1 10/2005 Baudat
2005/0274126 A1 12/2005 Baudat
2006/0010911 A1 1/2006 Hubbard et al.
2006/0053806 A1 3/2006 Tassel
2006/0075762 A1 4/2006 Wijngaarden et al.
2006/0180231 A1 8/2006 Harland et al.
2006/0231155 A1 10/2006 Harland et al.
2007/0074786 A1 4/2007 Adkins et al.
2007/0095427 A1 5/2007 Ehrhardt et al.
2007/0289517 A1 12/2007 Poldervaart et al.

FOREIGN PATENT DOCUMENTS

DE 3338237 5/1985
EP 0134690 A2 3/1985
EP 306972 A1 * 3/1989
GB 2094461 9/1982
JP 53126003 11/1978
JP 54008242 1/1979
JP 58113699 7/1983
JP 63203995 A 8/1988
JP 63203996 A 8/1988
JP 2003074793 A * 3/2003
JP 2005098480 10/2006
WO 0103793 A1 1/2001
WO 03053774 A1 7/2003
WO 03085317 A1 10/2003
WO 2005110016 A2 11/2005
WO 2006030316 A2 3/2006
WO 2006088371 A1 8/2006

OTHER PUBLICATIONS

Larsen, et al. "SRV, The LNG Shuttle and Regas Vessel System", Offshore Technology Conference 16580, Houston, May 2004.
FERC Publication, "Draft Environmental Impact Statement for Dominion Cove Point LNG . . . ", Chapter 23, p. 3-6 Oct. 2005.
Excelerate, LLC "Breaking the Traditional Model—Bringing Continents of Energy Together, Energy Bridge", CWC Sixth Annual World LNG Summit Rome 2005, Nov. 2005.
Hoegh LNG, "Future Technological Challenges in LNG Shipping", LNG Journal, Norshipping, 2005.
Cook, J.W., "Special Session: Energy Bridge LNG Projects: Gulf Gateway Energy Bridge—The First Year of Operations and the Commercial and Operational Advantages of the Energy Bridge Technology", Offshore Technology Conference 18396, Houston, May 2006.
Worthington, W.S. and B.S. Hubbard, "Improved Regasification Methods Reduce Emissions", Hydrocarbon Processing, Gulf Publishing co., pp. 51-54, HydrocarbonProcessing.com, Jul. 2005.
Excelerate Energy. "Development Information." www.excelerateenergy.com (Nov. 30, 2005): 1-3.
Excelerate Energy. "Energy Bridge Regasification Vessels." www.excelerateenergy.com (Nov. 30, 2005): 1.
Lane, Mark, "Energy Bridge Maximizing Utilization," presented to the United States Coast Guard, Port Arthur, TX, Jun. 16, 2005.
Excelerate Energy Limited Partnership, "Lessons Learned from Permitting, Building, and Operating the Gulf Gateway Energy Bridge Deepwater Port," Oil & Gas IQ Conference, LNG Terminals: Sitting, Permitting, and Financing a Successful LNG Project, Costa Mesa, CA, Sep. 14, 2005.
Bryngelson, Rob, "Excelerate Energy Northeast Gateway and Gulf Gateway Deepwater Port Update," Northeast Energy and Commerce Association, 11th Annual Conference on Natural Gas Issues, Boston, MA, Sep. 19, 2005.

Cook, Jonathan & Lane, Mark, "LNG Ship-to-Ship Transfer," SIGTTO, Houston, TX, Nov. 18, 2005.
Excelerate Energy Limited Partnership, "Liquefied Natural Gas Storage and Transport for Russia," presented to the U.S. Department of Commerce SABIT Group Program, The Woodlands, Texas, Aug. 31, 2006.
Zabiate et al., "Single point mooring system for floating LNG plant", Ocean Industry,Nov. 1978, pp. 75, 77, and 78.
Campbell et al., "Shipboard Regasification Terminal", proceedings of the Seventy-Eighth GPA Annual Convention (1999) pp. 295-298.
Van Tassel, "An Economic System for the Liquefaction, Transportation, and Regas of Natural Gas using Surplus LNG Carriers", International Marine Symposium, New York 1984, pp. 171-177.
A.A. Avidan, "Innovative Solutions to Lower LNG Import Terminal Costs for Emerging LNG markets", presented at Gastech Nov. 29, 1998-Dec. 2, 1998.
"Concept Proposal for the Transportation and Regasification of Liquid Natural Gas", Argent Marine Operations, Inc., published 1996.
Rajabi et al., "The Heidrun Field: Oil Offtake System", OTC 8102, Offshore Technology Conference, May 6-9, 1996.
"High purity, high flow rate vaporization presents a system challenge for Cryoquip engineers", Frostbite Newsletter from Cryogenic Industries, vol. 12, No. 1, Spring 2002.
"Cryoquip engineers a unique heat exchanger with very high thermal efficiency", Frostbite Newsletter from Cryogenic Industries, vol. 13, No. 3, Spring 2003.
"Vaporizer ice build-up requires an analysis of switching issues for ambient air units", Frostbite Newsletter from Cryogenic Industries, vol. 8, No. 2, Winter 1996.
"Sub-Zero pumps achieve 85% efficiency levels", Frostbite Newsletter from Cryogenic Industries, vol. 9, No. 1, Spring 1998.
"LNG Receiving Terminal at Dahej, Gujarat, India", Paper Sessions, Thirteenth International Conference & Exhibition on Liquefied Natural Gas, Seoul, Korea, May 14-17, 2001.
H. Werner, "The Flexible Solution—I.M. Skaugen's Fleet of Small Scale LNG Carriers", IMS—Innovative Maritime Solutions, Oslo 2007, pp. 1-22.

* cited by examiner

REGASIFICATION OF LNG USING AMBIENT AIR AND SUPPLEMENTAL HEAT

CROSS-REFERENCE TO RELATED APPLICATION

This application claims priority from U.S. Provisional Patent Application Ser. No. 60/782,282, entitled "Onboard Regasification of LNG" and filed Mar. 15, 2006. The disclosure of the above-identified patent application is incorporated herein by reference in its entirety.

FIELD OF THE INVENTION

The present invention relates to a method and apparatus for regasification of liquefied natural gas ("LNG") which relies on ambient air as the primary source of heat for vaporization and which is capable of being operated on a substantially continuous basis.

BACKGROUND TO THE INVENTION

Natural gas is the cleanest burning fossil fuel as it produces less emissions and pollutants than either coal or oil. Natural gas ("NG") is routinely transported from one location to another location in its liquid state as "Liquefied Natural Gas ("LNG"). Liquefaction of the natural gas makes it more economical to transport as LNG occupies only about 1/600th of the volume that the same amount of natural gas does in its gaseous state. Transportation of LNG from one location to another is most commonly achieved using double-hulled ocean-going vessels with cryogenic storage capability referred to as "LNGCs". LNG is typically stored in cryogenic storage tanks onboard the LNGC, the storage tanks being operated either at or slightly above atmospheric pressure. The majority of existing LNGCs have an LNG cargo storage capacity in the size range of 120,000 $m^3$ to 150,000 $m^3$, with some LNGCs having a storage capacity of up to 264,000 $m^3$.

LNG is normally regasified to natural gas before distribution to end users through a pipeline or other distribution network at a temperature and pressure that meets the delivery requirements of the end users. Regasification of the LNG is most commonly achieved by raising the temperature of the LNG above the LNG boiling point for a given pressure. It is common for an LNGC to receive its cargo of LNG at an "export terminal" located in one country and then sail across the ocean to deliver its cargo at an "import terminal" located in another country. Upon arrival at the import terminal, the LNGC traditionally berths at a pier or jetty and offloads the LNG as a liquid to an onshore storage and regasification facility located at the import terminal. The onshore regasification facility typically comprises a plurality of heaters or vaporizers, pumps and compressors. Such onshore storage and regasification facilities are typically large and the costs associated with building and operating such facilities are significant.

Recently, public concern over the costs and sovereign risk associated with construction of onshore regasification facilities has led to the building of offshore regasification terminals which are removed from populated areas and onshore activities. Various offshore terminals with different configurations and combinations have been proposed. For example, U.S. Pat. No. 6,089,022 describes a system and a method for regasifying LNG aboard a carrier vessel before the re-vaporized natural gas is transferred to shore for delivery to an onshore facility. The LNG is regasified using seawater taken from the body of water surrounding the carrier vessel which is flowed through a regasification facility that is fitted to and thus travels with the carrier vessel all of the way from the export terminal to the import terminal. The seawater exchanges heat with the LNG to vaporize the LNG to natural gas and the cooled seawater is returned to the body of water surrounding the carrier vessel. Seawater is an inexpensive source of intermediate fluid for LNG vaporisation but has become less attractive due to environmental concerns, in particular, the environmental impact of returning cooled seawater to a marine environment.

Regasification of LNG is generally conducted using one of the following three types of vaporizers: an open rack type, an intermediate fluid type or a submerged combustion type.

Open rack type vaporizers typically use sea water as a heat source for the vaporization of LNG. These vaporizers use once-through seawater flow on the outside of a heater as the source of heat for the vaporization. They do not block up from freezing water, are easy to operate and maintain, but they are expensive to build. They are widely used in Japan. Their use in the USA and Europe is limited and economically difficult to justify for several reasons. First the present permitting environment does not allow returning the seawater to the sea at a very cold temperature because of environmental concerns for marine life. Also coastal waters like those of the southern USA are often not clean and contain a lot of suspended solids, which could require filtration. With these restraints the use of open rack type vaporizers in the USA is environmentally and economically not feasible.

Instead of vaporizing liquefied natural gas by direct heating with water or steam, vaporizers of the intermediate fluid type use propane, fluorinated hydrocarbons or like refrigerant having a low freezing point. The refrigerant is heated with hot water or steam first to utilize the evaporation and condensation of the refrigerant for the vaporization of liquefied natural gas. Vaporizers of this type are less expensive to build than those of the open rack-type but require heating means, such as a burner, for the preparation of hot water or steam and are therefore costly to operate due to fuel consumption.

Vaporizers of the submerged combustion type comprise a tube immersed in water which is heated with a combustion gas injected thereinto from a burner. Like the intermediate fluid type, the vaporizers of the submerged combustion type involve a fuel cost and are expensive to operate. Evaporators of the submerged combustion type comprise a water bath in which the flue gas tube of a gas burner is installed as well as the exchanger tube bundle for the vaporization of the liquefied natural gas. The gas burner discharges the combustion flue gases into the water bath, which heat the water and provide the heat for the vaporization of the liquefied natural gas. The liquefied natural gas flows through the tube bundle. Evaporators of this type are reliable and of compact size, but they involve the use of fuel gas and thus are expensive to operate.

It is known to use ambient air or "atmospheric" vaporizers to vaporize a cryogenic liquid into gaseous form for certain downstream operations.

For example, U.S. Pat. No. 4,399,660, issued on Aug. 23, 1983 to Vogler, Jr. et al., describes an ambient air vaporizer suitable for vaporizing cryogenic liquids on a continuous basis. This device employs heat absorbed from the ambient air. At least three substantially vertical passes are piped together. Each pass includes a center tube with a plurality of fins substantially equally spaced around the tube.

U.S. Pat. No. 5,251,452, issued on Oct. 12, 1993 to L. Z. Widder, discloses an ambient air vaporizer and heater for cryogenic liquids. This apparatus utilizes a plurality of vertically mounted and parallelly connected heat exchange tubes.

Each tube has a plurality of external fins and a plurality of internal peripheral passageways symmetrically arranged in fluid communication with a central opening. A solid bar extends within the central opening for a predetermined length of each tube to increase the rate of heat transfer between the cryogenic fluid in its vapor phase and the ambient air. The fluid is raised from its boiling point at the bottom of the tubes to a temperature at the top suitable for manufacturing and other operations.

U.S. Pat. No. 6,622,492, issued Sep. 23, 2003, to Eyermann, discloses apparatus and process for vaporizing liquefied natural gas including the extraction of heat from ambient air to heat circulating water. The heat exchange process includes a heater for the vaporization of liquefied natural gas, a circulating water system, and a water tower extracting heat from the ambient air to heat the circulating water.

U.S. Pat. No. 6,644,041, issued Nov. 11, 2003 to Eyermann, discloses a process for vaporizing liquefied natural gas including passing water into a water tower so as to elevate a temperature of the water, pumping the elevated temperature water through a first heater, passing a circulating fluid through the first heater so as to transfer heat from the elevated temperature water into the circulating fluid, passing the liquefied natural gas into a second heater, pumping the heated circulating fluid from the first heater into the second heater so as to transfer heat from the circulating fluid to the liquefied natural gas, and discharging vaporized natural gas from the second heater.

Atmospheric vaporizers are not generally used for continuous service because ice and frost build up on the outside surfaces of the atmospheric vaporizer, rendering the unit inefficient after a sustained period of use. The rate of accumulation of ice on the external fins depends in part on the differential in temperature between ambient temperature and the temperature of the cryogenic liquid inside of the tube. Typically the largest portion of the ice packs tends to form on the tubes closest to the inlet, with little, if any, ice accumulating on the tubes near the outlet unless the ambient temperature is near or below freezing. It is therefore not uncommon for an ambient air vaporizer to have an uneven distribution of ice over the tubes which can shift the centre of gravity of the unit and which result in differential thermal gradients between the tubes.

In spite of the advancements of the prior art, there is still a need in the art for improved apparatus and methods for regasification of LNG using ambient air as the primary source of heat.

SUMMARY OF THE INVENTION

According to a first aspect of the present invention there is provided a process for regasification of LNG to form natural gas, said process comprising the steps of:

(a) circulating an intermediate fluid between a vaporizer and an ambient air heater, the intermediate fluid being warmed by exchanging heat with the ambient air as the intermediate fluid passes through the ambient air heater, the intermediate fluid being cooled by exchanging heat with LNG as the intermediate fluid passes through the vaporizer; and, (b) subjecting the ambient air heater to a defrosting cycle by intermittently regulating the temperature of the intermediate fluid fed to the ambient air heater to a temperature greater than zero degrees Celsius using a source of supplemental heat.

In one embodiment, step (b) is conducted downstream of the ambient air heater.

The source of supplemental heat may be selected from the group consisting of: an exhaust gas heater; an electric water or fluid heater; a propulsion unit of a ship; a diesel engine; or a gas turbine propulsion plant; or an exhaust gas stream from a power generation plant.

In one embodiment, regasification of the LNG is conducted onboard an LNG carrier and the source of supplementary heat is heat recovered from the engines of the LNG carrier.

Heat exchange between the ambient air and the intermediate fluid in the ambient air heater may be encouraged through use of forced draft fans.

The intermediate fluid may be selected from the group consisting of: a glycol, a glycol-water mixture, methanol, propanol, propane, butane, ammonia, a formate, fresh water or tempered water. Preferably, the intermediate fluid may comprise a solution containing an alkali metal formate or an alkali metal acetate. More specifically, the alkali metal formate may be potassium formate, sodium formate or an aqueous solution of ammonium formate or the alkali metal acetate is potassium acetate or ammonium acetate.

In one embodiment, the ambient air heater is one of a plurality of ambient air heaters and step (b) is performed on each of the plurality of ambient air heaters sequentially. Alternatively or additionally, the ambient air heater comprises a horizontal tube bundle for exchanging heat with the intermediate fluid when the temperature of the ambient air is above 0° C. and a vertical tube bundle for exchanging heat with ambient air when the temperature of the ambient temperature falls below 0° C. Heat exchange between the ambient air and the intermediate fluid in the ambient air heater may be encouraged through use of forced draft fans with the horizontal tube bundle lies above the vertical tube bundle in closer proximity to forced draft fans.

According to a second aspect of the present invention there is provided a regasification facility for regasification of LNG to form natural gas, said apparatus comprising:

a vaporizer for regasifying LNG to natural gas;

an ambient air heater for heating an intermediate fluid using ambient air as the primary source of heat;

a circulating pump for circulating the intermediate fluid between the vaporizer and the ambient air heater, the intermediate fluid being warmed by exchanging heat with the ambient air as the intermediate fluid passes through the ambient air heater, the intermediate fluid being cooled by exchanging heat with LNG as the intermediate fluid passes through the vaporizer; and, a control device for regulating the temperature of the intermediate fluid fed to the ambient air heater to a temperature greater than zero degrees Celsius using a source of supplemental heat to subject the ambient air heater to a defrosting cycle.

In one embodiment, the source of supplemental heat is located downstream of the ambient air heater. The source of supplemental heat may be selected from the group consisting of: an exhaust gas heater; an electric water or fluid heater; a propulsion unit of a ship; a diesel engine; or a gas turbine propulsion plant; or an exhaust gas stream from a power generation plant.

In one embodiment, the regasification facility is provided onboard an LNG carrier and the source of supplementary heat is heat recovered from the engines of the LNG carrier. Alternatively or additionally, the apparatus further comprises a forced draft fan for encouraging heat exchange between the ambient air and the intermediate fluid in the ambient air heater.

In one embodiment, the ambient air heater is one of a plurality of ambient air heaters and the control device is arranged to subject each of the plurality of ambient air heaters sequentially to a defrosting cycle. Preferably, the ambient air heater comprises a horizontal tube bundle for exchanging heat with the intermediate fluid when the temperature of the ambient air is above 0° C. and a vertical tube bundle for exchanging heat with ambient air when the temperature of the ambient temperature falls below 0° C. Heat exchange between the ambient air and the intermediate fluid in the ambient air heater may be encouraged through use of forced draft fans and the horizontal tube bundle lies above the vertical tube bundle in closer proximity to forced draft fans.

BRIEF DESCRIPTION OF THE DRAWINGS

In order to facilitate a more detailed understanding of the nature of the invention several embodiments of the present invention will now be described in detail, by way of example only, with reference to the accompanying drawings, in which.

DETAILED DESCRIPTION OF PREFERRED EMBODIMENTS

Figure 1:
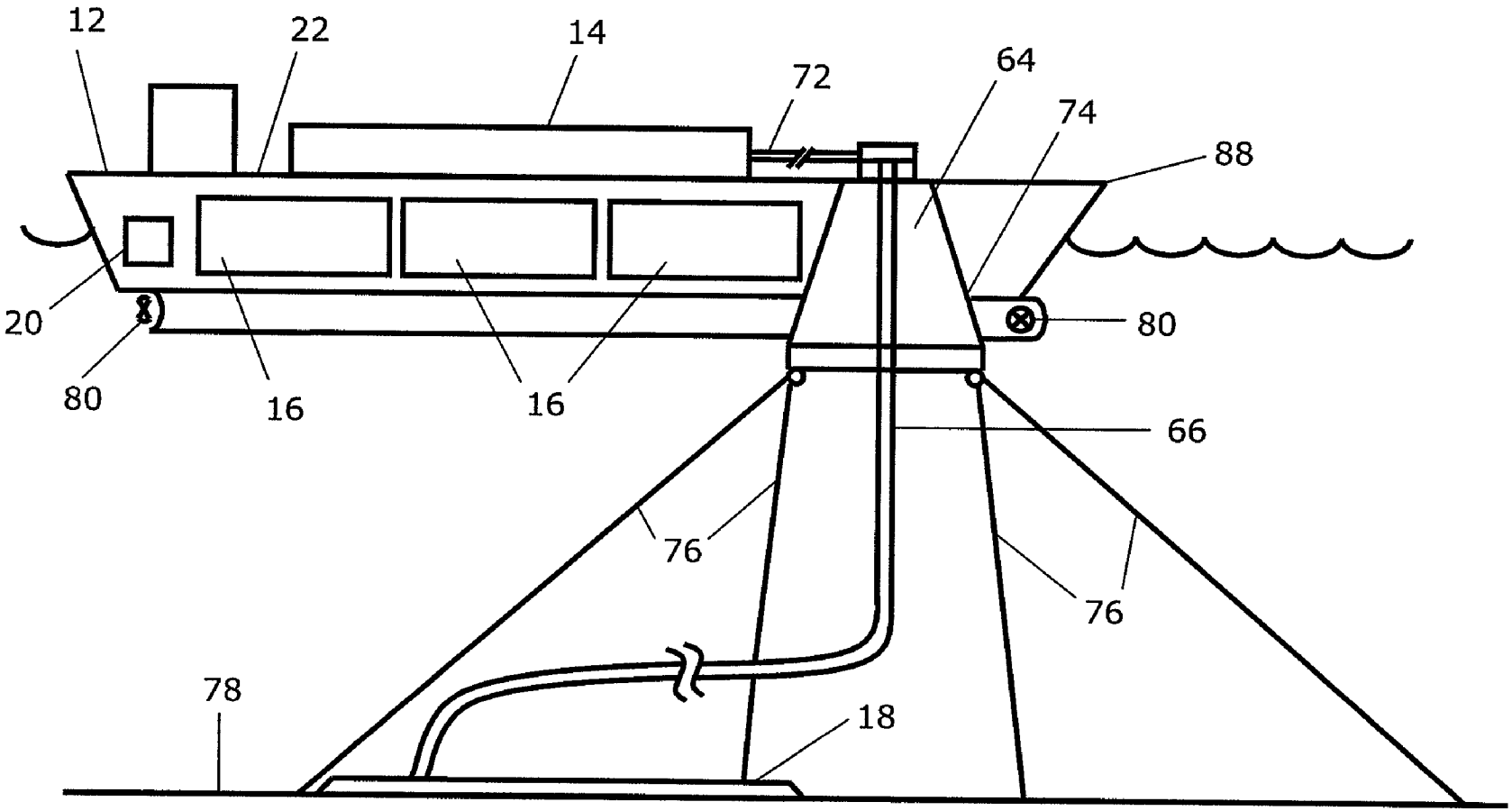
FIG. 1 is a schematic side view of the RLNGC moored at a turret mooring buoy through which the natural gas is from the onboard regasification facility is transferred via a marine riser associated with a sub-sea pipeline to shore.

Particular embodiments of the method and apparatus for regasification of LNG using ambient air as the primary source of heat for vaporization are now described, with particular reference to the offshore regasification of LNG aboard an LNG Carrier, by way of example only. The present invention is equally applicable to use for an onshore regasification facility or for use on a fixed offshore platform or barge. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs. In the drawings, it should be understood that like reference numbers refer to like members.

Throughout this specification the term "RLNGC" refers to a self-propelled vessel, ship or LNG carrier provided an onboard regasification facility which is used to convert LNG to natural gas. The RLNGC can be a modified ocean-going LNG vessel or a vessel that is custom or purpose built to include the onboard regasification facility.

The term "vaporizer" refers to a device which is used to convert a liquid into a gas.

A first embodiment of the system of the present invention is now described with reference to FIGS. 1 and 2. In this first embodiment, a regasification facility 14 is provided onboard an RLNGC 12 and is used to regasify LNG that is stored aboard the RLNGC in one or more cryogenic storage tanks 16. The onboard regasification facility 14 uses ambient air as the primary source of heat for regasification of the LNG and relies on circulating intermediate heat transfer fluid to transfer the heat from the ambient air to the LNG. The natural gas produced using the onboard regasification facility 14 is transferred to a sub-sea pipeline 18 for delivery of the natural gas to an onshore gas distribution facility (not shown).

In one embodiment of the present invention, LNG is stored aboard the RLNGC in 4 to 7 prismatic self-supporting cryogenic storage tanks, each storage tank 16 having a gross storage capacity in the range of 30,000 to 50,000 $m^3$. The RLNGC 12 has a supporting hull structure capable of withstanding the loads imposed from intermediate filling levels in the storage tanks 16 when the RLNGC 12 is subject to harsh, multi-directional environmental conditions. The storage tank (s) 16 onboard the RLNGC 12 are robust to or reduce sloshing of the LNG when the storage tanks are partly filled or when the RLNGC is riding out a storm whilst moored. To reduce the effects of sloshing, the storage tank(s) 16 are provided with a plurality of internal baffles or a reinforced membrane. The use of membrane tanks allows more space on the deck 22 of the RLNGC 12 for the regasification facility 14. Self supporting spherical cryogenic storage tanks, for example Moss type tanks, are not considered to be suitable if the RLNGC 12 is fitted with an onboard regasification facility 14, as Moss tanks reduce the deck area available to position the regasification facility 14 on the deck of the RLNGC 12.

A high pressure onboard piping system 24 is used to convey LNG from the storage tanks 16 to the regasification facility 14 via at least one cryogenic send-out pump 26. Examples of suitable cryogenic send-out pumps include a centrifugal pump, a positive-displacement pumps, a screw pump, a velocity-head pump, a rotary pump, a gear pump, a plunger pump, a piston pump, a vane pump, a radial-plunger pumps, a swash-plate pump, a smooth flow pump, a pulsating flow pump, or other pumps that meet the discharge head and flow rate requirements of the vaporizers. The capacity of the pump is selected based upon the type and quantity of vaporizers installed, the surface area and efficiency of the vaporizers and the degree of redundancy desired. They are also sized such that the RLNGC 12 can discharge its cargo at a conventional import terminal at a rate of 10,000 $m^3$/hr (nominal) with a peak in the range of 12,000 to 16,000 $m^3$/hr.

Figure 2:
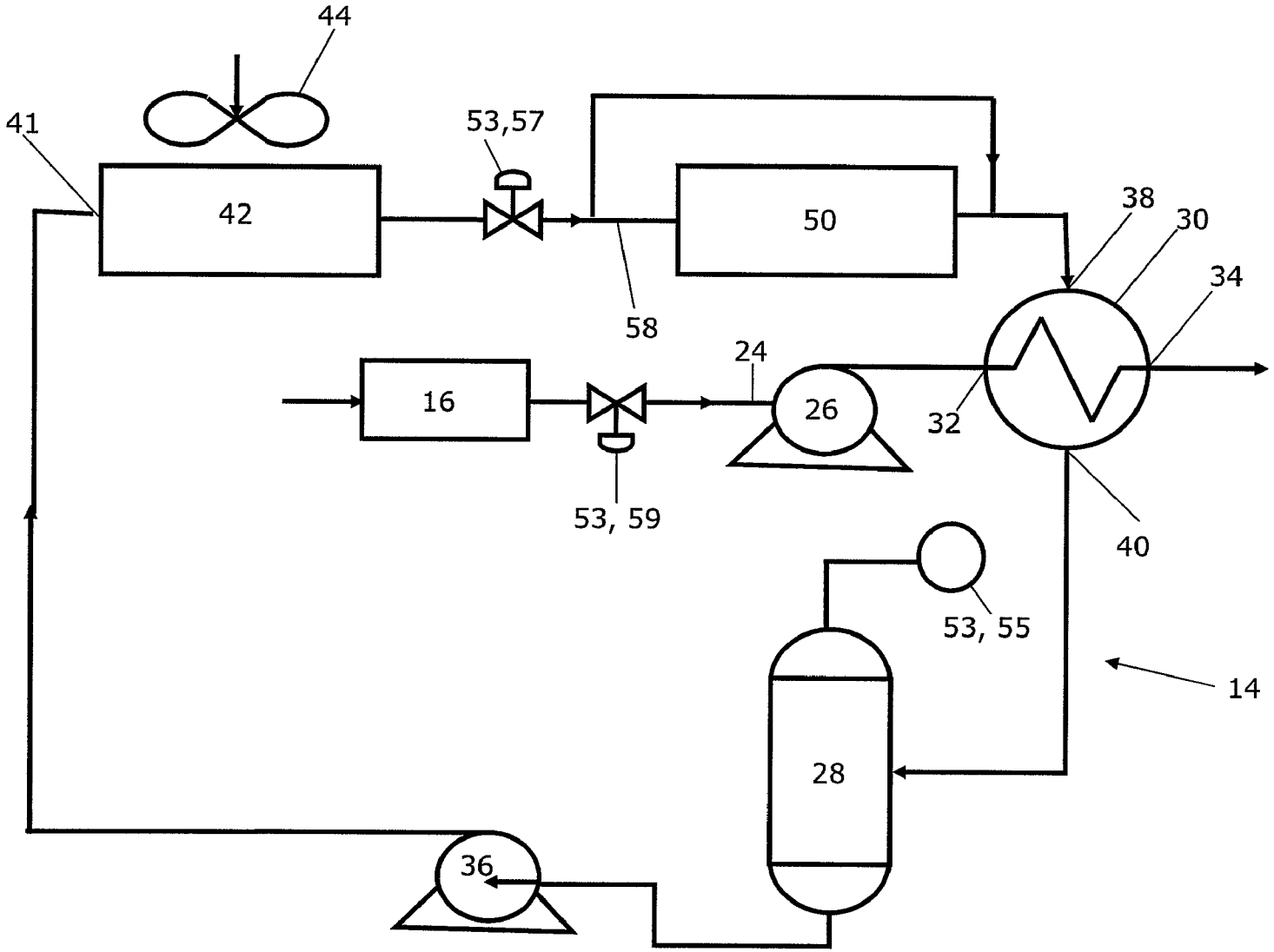
FIG. 2 is a flow chart illustrating a first embodiment of the regasification facility suitable for tropical climates where the minimum ambient temperature is about 10 to 15° C.
Figure 3:
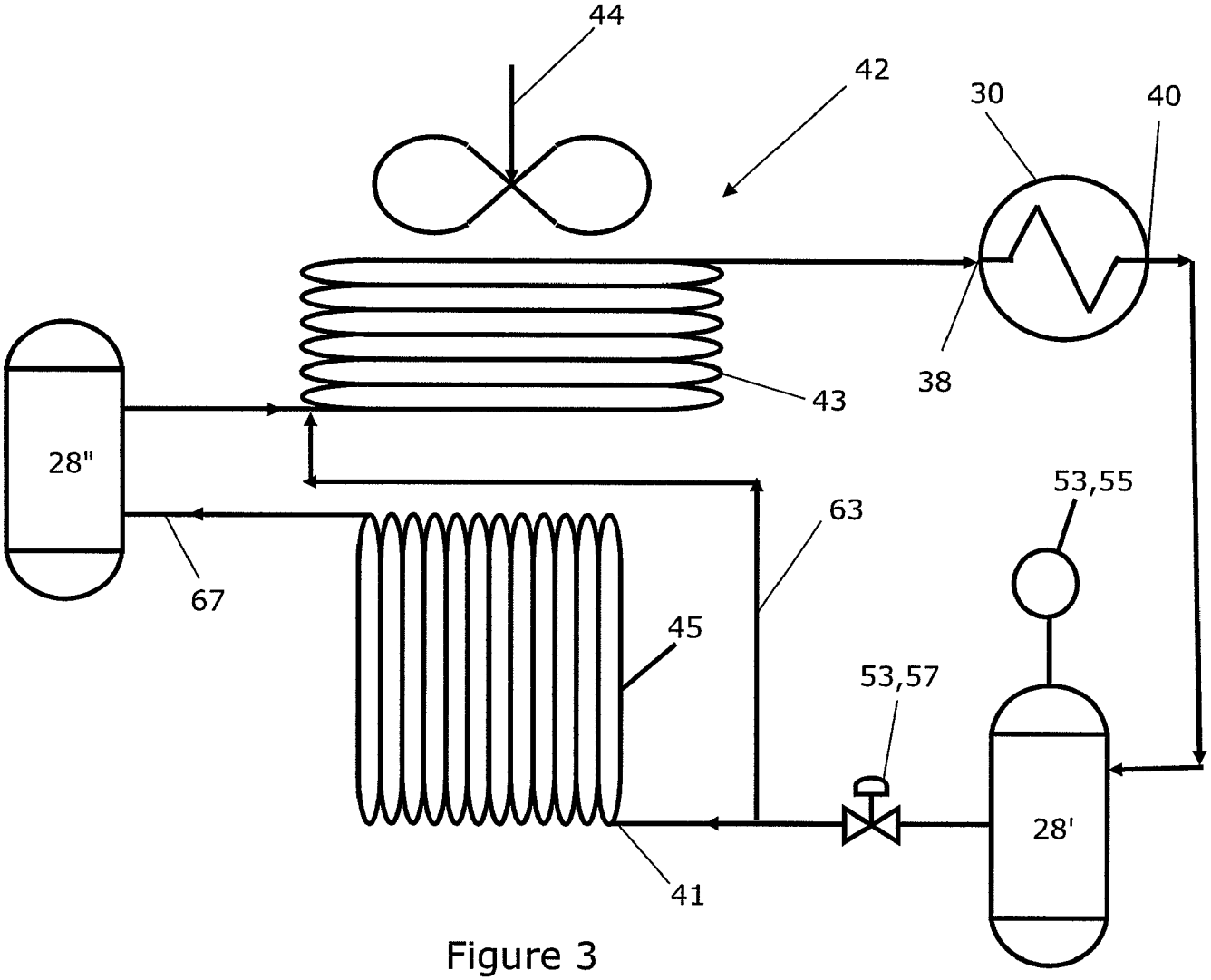
FIG. 3 illustrates one embodiment of the ambient air heater of FIG. 2 provided with a horizontal tube bundle and a vertical tube bundle.

A first embodiment of the regasification facility 14 is illustrated in FIGS. 2 and 3, which embodiment is particularly suitable for tropical climates where the minimum ambient temperature is about 10 to 15° C. The regasification facility 14 includes at least one vaporizer 30 for regasifying LNG to natural gas and at least one ambient air heater 42 for heating a circulating intermediate fluid. To provide sufficient surface area for heat exchange, the vaporizer 30 may be one of a plurality of vaporizers arranged in a variety of configurations, for example in series, in parallel or in banks. The vaporizer 30 can be a shell and tube heater, a finned tube heater, a bent-tube fixed-tube-sheet exchanger, a spiral tube exchanger, a plate-type heater, or any other heater commonly known by those skilled in the art that meets the temperature, volumetric and heat absorption requirements for quantity of LNG to be regasified.

In this embodiment, LNG from the storage tank 16 is pumped to the required send-out pressure through a high pressure onboard piping system 24 by send-out pump 26 to the tube-side inlet 32 of the vaporizer 30. In the vaporizer 30, the LNG is regasified to natural gas through heat exchange with a circulating intermediate heat transfer fluid. Warm intermediate fluid is directed to the shell-side inlet 38 of the vaporizer 30 using a circulating pump 36. The warm intermediate fluid transfers heat to the LNG to vaporize it to natural gas, and, in the process, the intermediate fluid is cooled. After the LNG has been vaporized in the tubes, it leaves the tube-side outlet 34 of the vaporizer 30 as natural gas. If the natural gas which exits the tube-side outlet 34 of the vaporizer 30 is not already at a temperature suitable for distribution into the sub-sea pipeline 18, its temperature and pressure can be boosted using, for example a trim heater (not shown).

The cold intermediate fluid which leaves the shell-side outlet 40 of the vaporizer 30 is directed via a surge tank 28 to one or more ambient air heater(s) 42 which warm the circulating intermediate fluid as a function of the temperature differential between the ambient air and the temperature of the cold intermediate fluid entering the heater 42. The cold intermediate fluid passes through the tubes of the ambient air heater 42, with ambient air acting on the external surfaces thereof. Heat transfer between the ambient air and the intermediate fluid can be assisted through the use of forced draft fans 44 arranged to direct the flow of air towards the ambient air heater 42, preferably in a downward direction.

The warm intermediate fluid which exits the ambient air heater 42 is returned to the vaporizer 30 to regasify the LNG. In this way, ambient air is used as the primary source of heat for regasification of the LNG. Ambient air is used (instead of heat from burning of fuel gas) as the primary source of heat for regasification of the LNG to keep emissions of nitrous oxide, sulphur dioxide, carbon dioxide, volatile organic compounds and particulate matter to a minimum. Heat is transferred to the intermediate fluid from the ambient air by virtue of the temperature differential between the ambient air and the cold intermediate fluid. As a result, the warm air is cooled, moisture in the air condenses and the latent heat of condensation provides an additional source of heat to be transferred to the circulating intermediate fluid in addition to the sensible heat from the air.

If the ambient temperature drops below a predetermined design average ambient temperature, a source of supplemental heat 50 is used to boost the temperature of the intermediate fluid to a required return temperature before the intermediate fluid enters the shell-side inlet 38 of the vaporizer 30. When the temperature of the ambient air is sufficiently high (for example during the summer months) such that the ambient air is able to supply sufficient heat for regasification of the LNG, the source of supplemental heat 50 can be shut down. Controlling the return temperature of the intermediate fluid in this way is advantageous as it allows the vaporizer 30 to be operated under substantially stead-state conditions which are independent of changes in the ambient air temperature.

The source of supplemental heat 50 is from engine cooling, waste heat recovery from power generation facilities and/or electrical heating from excess power from the power generation facilities, an exhaust gas heater; an electric water or fluid heater; a propulsion unit of the ship (when the regasification facility is onboard an RLNGC); a diesel engine; or a gas turbine propulsion plant.

When the ambient temperature drops to close to 0° C., the temperature of the cold intermediate fluid which enters the tube-side inlet 41 of the ambient air heater 42 will be much lower than 0° C. As a consequence, the moisture which condenses out of the ambient air freezes on the external surfaces of the ambient air heater 42 and ice is formed. The rate and degree of icing which occurs depends on a number of relevant factors including but not limited to the temperature and relative humidity of the ambient air, the flow rate of the intermediate fluid through the ambient air heater 42, and the heat transfer characteristics of the intermediate fluid and the materials of construction of the ambient air heater. The temperature and relative humidity of the ambient air can vary according to the seasons or the type of climate in the location at which regasification is conducted.

In tropical climates where the ambient temperature is significantly above 0° C. all year round, but drops below 0° C. during the night, ice is allowed to form on the external surfaces of the ambient air heater 42 during the night and the ambient air heater 42 is subjected to a defrosting cycle during daylight operations. As the ambient air temperature rises during daylight operations, a control device 53, in the form of a temperature sensor 55 cooperatively associated with a flow control valve 57, is used to ensure that the temperature of the cold intermediate fluid which enters the tube-side inlet 41 of the ambient air heater 42 is boosted and maintained above 0° C. By boosting and maintaining the temperature of the intermediate fluid which enters the tube-side inlet above 0° C., the ice which has accumulated on the external surfaces of the ambient air heater 42 overnight is caused to melt during the day. In this way, the ambient air heater 42 undergoes routine defrosting each day to improve efficiency, allowing the regasification facility 14 to operate on a continuous basis.

In the embodiment illustrated in FIG. 2, the temperature sensor 55 measures the temperature of the intermediate fluid in the surge tank 28 and generates a signal to the flow control valve 57 which regulates the percentage flow of a bypass stream 58 of intermediate fluid through the source of supplemental heat 50. In the event that the day-time ambient air temperature is so low that defrosting cannot be achieved even when all of the circulating intermediate fluid is directed to flow through the source of supplemental heat 50, the control device 53 can be used instead to reduce the flow rate of the LNG through the send-out pumps 26 using flow control valve 59. By reducing the flow rate of the LNG to the vaporizer 30, the temperature of the cold intermediate fluid which leaves the shell-side outlet 40 of the vaporizer 30 rises. The control device 53 is used in this way to boost and maintain the temperature of the cold intermediate fluid which enters the tube inlet side 41 of the ambient air heaters above 0° C. to achieve defrosting.

To facilitate use of the process and apparatus of FIG. 2 in any climate, one specific embodiment of the ambient air heater 42 is illustrated in FIG. 3, for which like reference numerals refer to like parts. With reference to FIG. 3, the ambient air heater 42 comprises a horizontal tube bundle 43 (with the tubes arranged in an analogous manner to the tubes of a convention fin fan heater) and a vertical tube bundle 45. The cold intermediate fluid which exits the shell-side outlet 40 of the vaporizer 30 is directed to a first surge tank 28' and the temperature of the cold intermediate fluid is measured using a control device 53, in the form of a temperature sensor 55 positioned at the first surge tank 28' cooperatively associated with flow control valve 57. The control device 53 is used to regulate the proportion of intermediate fluid which allowed to flow through each of the horizontal and vertical tube bundles, 43 and 45 respectively, as a function of the temperature of the cold intermediate fluid measured by the temperature sensor 55.

The horizontal tube bundle 43 is ill-adapted for operation under conditions under which icing occurs. Therefore, the control device 53 allows the cold intermediate fluid to flow through the horizontal tube bundle 43 only if the temperature of the cold intermediate fluid measured by the temperature sensor 55 is greater than 0° C. The vertical tube bundle 45 is able to tolerate icing conditions due to the vertical arrangement of the tube bundle. Therefore, the control device 53 directs the cold intermediate fluid to flow through the vertical tube bundle 45 when the temperature of the cold intermediate fluid measured by the temperature sensor 55 is less than or equal to 0° C.

The cold intermediate fluid enters the vertical tube bundle 45 at the lowermost end of the vertical tube bundle 45 and is caused to flow upwardly therethrough. The partially warmed stream of intermediate fluid 67 which exits the vertical tube bundle 45 is directed to a second surge tank 28". The temperature of the intermediate fluid which enters the surge tank 28" has been raised above 0° C. and this partially warmed stream of intermediate fluid 67 is allowed to flow through the horizontal tube bundle 43 to further boost the temperature of the intermediate fluid before it is returned to the vaporizer 30.

In the embodiment of FIG. 3, the horizontal tube bundle 43 is physically arranged to lie above the vertical tube bundle 45 and in closer proximity to forced draft fans 44 which direct the flow of ambient air across the horizontal tube bundle 43. This arrangement is adopted to reduce the overall footprint of the regasification facility 14 and to provide optimum heat transfer efficiency.

A second non-limiting embodiment of the present invention is illustrated with reference to FIG. 4 for which like reference numerals refer to like parts. This embodiment is particularly suitable for mildly cold climates. In this embodiment, LNG is pumped from the storage tank 16 at a nominal rate to the vaporizer 30 using send-out pumps 26 as described above. The cold intermediate fluid which exits the shell to a plurality of ambient air heaters 42, each heater being arranged to exchange heat with ambient air.

Figure 4:
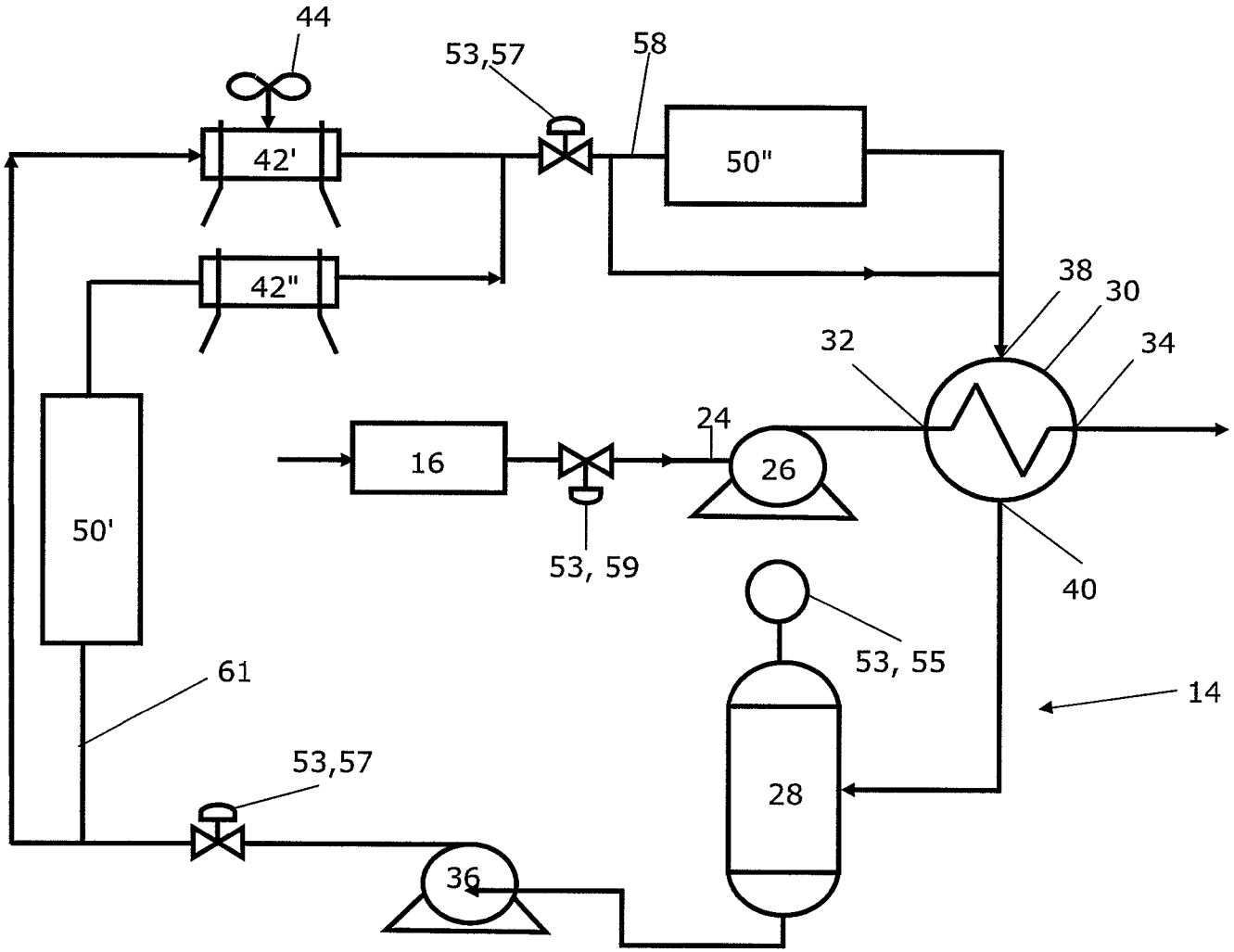
FIG. 4 is a flow chart illustrating a second embodiment of the regasification facility suitable for mildly cold climates; and, FIG. 5 is a flow chart illustrating a third embodiment of the regasification facility suitable for much colder climates using supplemental heat provided by heat recovery and also from a back-up heater operating using a closed loop system in which a water-glycol mixture or other auxiliary fluid is heated using heat from a fired heater.

With reference to FIG. 4, the first ambient air heater 42' is arranged to receive cold intermediate fluid from the vaporizer 30. The second ambient air heater 42" is arranged to receive a bypass stream 61 of the intermediate fluid which has been directed to flow through a source of supplemental heat 50 upstream of the second ambient air heater 42". The temperature of the cold intermediate fluid which exits the shell-side outlet 40 of the vaporizer 30 is measured using the control device 53, in the form of a temperature sensor 55 cooperatively associated with a flow control valve 57. The control valve 57 is used to regulate the proportion of intermediate fluid which allowed to flow through each of the ambient heaters 42' and 42" by controlling the percentage flow rate of the bypass stream 61. The source of supplemental heat 50' is used to boost the temperature of the bypass stream 61 above 0° C. before the intermediate fluid enters the second ambient air heater 42" and this is done so as to subject the second ambient air heater 42" to a defrost cycle to remove ice which has formed on the external surfaces of the second ambient air heater 42". The remaining cold circulating intermediate fluid enters directly into the tubes of the first ambient air heater 42' and exchanges heat with ambient air in the manner described above in relation to the first embodiment.

It is to be clearly understood that whilst FIG. 4 illustrates the flow diagram used to arrange defrosting of the second ambient air heater 42", the control device 53 is arranged to allow defrosting of each and all of the plurality of ambient air heaters 42' and 42" in turn. Whilst only two such ambient air heaters 42 are illustrated in FIG. 4, it is to be understood that the regasification facility 14 can equally comprise a larger number of heaters to suit the capacity of natural gas to be delivered from the regasification facility. These ambient air heaters 42 can be arranged in a variety of configurations, for example in series, in parallel or in banks. It is preferable that the ambient air heaters are capable of withstanding the forces generated when ice is allowed to form on the external surfaces of the heater and in this regard, vertical tube bundles are preferred to horizontal tube bundles.

Using this arrangement, at least one of the plurality of heaters 42 is operating at maximum heat transfer capacity (in that the temperature differential between the cold intermediate fluid and the ambient air is kept to a maximum), so as to use the ambient air as the primary source of heat for regasification of the LNG to form natural gas. At the same time, at least one of the plurality of heaters is being subject to a defrost cycle to overcome any reduction in efficiency due to icing. If desired, the temperature of the circulating intermediate fluid downstream of the plurality of heaters 42 can be boosted before returning the warm intermediate fluid to the shell-side inlet 38 of the vaporizer 30 using a second source of supplemental heat 50" in the manner described above for the first embodiment.

Figure 5:
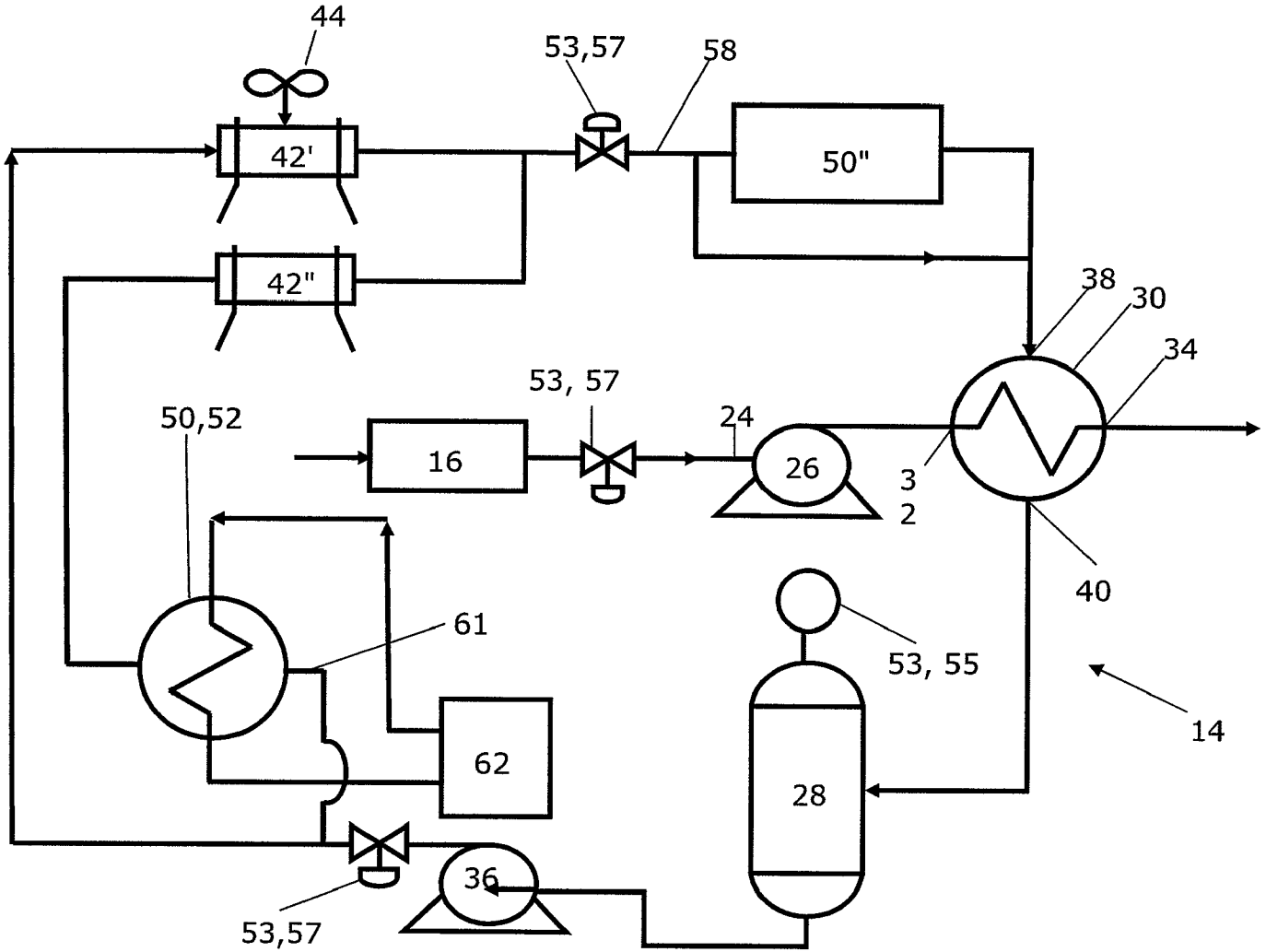

A third non-limiting embodiment of the present invention is illustrated with reference to FIG. 5 for which like reference numerals refer to like parts. This embodiment is particularly suitable for use in much colder climates. This embodiment is similar to the embodiment illustrated in FIG. 4, the main difference being that the source of supplemental heat 50 used to boost the temperature of bypass stream 61 is in the form of a closed loop supplemental heat exchanger 52. The bypass stream 61 passes through the tubes of the supplemental heat exchanger 52 and exchanges heat with an auxiliary intermediate heat transfer fluid (such as fresh water, tempered water, glycol or a mixture thereof which is heated by fired heater 62.

With reference to the embodiment illustrated in FIG. 1, the RLNGC 12 is designed or retrofitted to include a recess or "moonpool" 74 to facilitate docking of the RLNGC 12 with an internal turret mooring buoy 64. The RLNGC 12 connects to the mooring buoy 64 in a manner that permits the RLNGC 12 to weathervane around the turret mooring buoy 64. The mooring buoy 64 is moored by anchor lines 76 to the seabed 78. The mooring buoy 64 is provided with one or more marine risers 66 which serve as conduits for the delivery of regasified natural gas through the mooring buoy 64 to the sub-sea pipeline 18. Fluid-tight connections are made between the inlet of the marine risers 66 and a gas delivery line 72 to allow the transfer of natural gas from the regasification facility 14 onboard the RLNGC 12 to the marine riser 66. A rigid arm connection over the bow 88 of the RLNGC to a single point or a riser turret mooring could equally be used, but is not preferred.

To allow the RLNGC 12 to pick up the mooring buoy 64 without assistance, the RLNGC 12 is highly maneuverable. In one embodiment, the RLNGC 12 is provided with directionally controlled propellers 48 which are capable of 360 degree rotation. The propulsion plant of the RLNGC 12 comprises twin screw, fixed pitch propellers 80 with transverse thrusters located both forward and aft that provide the RLNGC 12 with mooring and position capability. A key advantage of the use of a RLNGC 12 over a permanently moored offshore storage structure such as a gravity-based structure or a barge, is that the RLNGC 12 is capable of travelling under its own power offshore or up and down a coastline to avoid extreme weather conditions or to avoid a threat of terrorism or to transit to a dockyard or to transit to another LNG import or export terminal. In this event, the RLNGC 12 may do so with or without LNG stored onboard during this journey. Similarly, if demand for gas no longer exists at a particular location, the RLNGC 12 can sail under its own power to another location where demand is higher.

The RLNGC 12 is provided with an engine 20, preferably a dual fuelled engine, for providing mechanical drive to the propellers of the RLNGC 12 so as to move the ship from one location to another. Advantageously, during regasification, the RLNGC is moored to a mooring buoy, at which time the engine 20 can be used to provide electricity to generate heat and/or to run the pumps 26 and 36 and other equipment associated with the regasification facility 14. Thus, in the embodiment illustrated in FIG. 5, the bypass stream 61 which flows through the supplemental heater 50 exchanges heat with an auxiliary heat transfer fluid such as fresh or tempered water, which in turn has been heated using waste heat from the engine 20 of the RLNGC 12. In the process, the intermediate fluid is warmed and the engine 20 of the RLNGC 12 is cooled. This arrangement has the advantage of eliminating the use of large quantities of sea water which would otherwise be utilized for cooling the engines of a traditional LNG Carrier.

Suitable intermediate fluids for use in the process and apparatus of the present invention include: glycol (such as ethylene glycol, diethylene glycol, triethylene glycol, or a mixture of them), glycol-water mixtures, methanol, propanol, propane, butane, ammonia, formate, tempered water or fresh water or any other fluid with an acceptable heat capacity, freezing and boiling points that is commonly known to a person skilled in the art. It is desirable to use an environmentally more acceptable material than glycol for the intermediate fluid. In this regard, it is preferable to use an intermediate fluid which comprises a solution containing an alkali metal formate, such as potassium formate or sodium formate in water or an aqueous solution of ammonium formate. Alternatively or additionally, an alkali metal acetate such as potassium acetate, or ammonium acetate may be used. The solutions may include amounts of alkali metal halides calculated to improve the freeze resistance of the combination, that is, to lower the freeze point beyond the level of a solution of potassium formate alone. For example, potassium formate can be used to operate at temperatures as low as −70° C. during cold weather conditions in North America, Europe, Canada and anywhere else where ambient temperatures can fall below 0° C.

The advantage of using an intermediate fluid with a low freezing point is that the cold intermediate fluid which exits the shell-side outlet 40 of the vaporizer 30 can be allowed to drop to a temperature in the range of −20 to −70° C., depending on the freezing point of the particular type of intermediate fluid selected. This allows the ambient air heater 42 to operate efficiently even if the ambient air temperature falls to 0° C. Under such conditions, the natural gas which exits the tube-side outlet 34 may require heating to meet pipeline specifications.

Now that several embodiments of the invention have been described in detail, it will be apparent to persons skilled in the relevant art that numerous variations and modifications can be made without departing from the basic inventive concepts. For example, whilst only one vaporizer 30 and only one ambient air heater 42 are shown in FIG. 2 for illustrative purposes, it is to be understood that the onboard regasification facility may comprise any number of vaporizers and heaters arranged in parallel or series depending on the capacity of each vaporizer and the quantity of LNG being regasified. The vaporizers, heaters and fans (if used) are designed to withstand the structural loads associated with being disposed on the deck of the RLNGC during transit of the vessel at sea including the loads associated with motions and possibly green water loads as well as the loads experienced whilst the RLNGC is moored offshore during regasification. All such modifications and variations are considered to be within the scope of the present invention, the nature of which is to be determined from the foregoing description and the appended claims.

All of the patents cited in this specification, are herein incorporated by reference. It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed:

1. A process for regasification of LNG to form natural gas, said process comprising the steps of:

(a) circulating an intermediate fluid between a vaporizer and an ambient air heater, the intermediate fluid being warmed by exchanging heat with the ambient air as the intermediate fluid passes through the ambient air heater, the intermediate fluid being cooled by exchanging heat with LNG as the intermediate fluid passes through the vaporizer; and, (b) subjecting the ambient air heater to a defrosting cycle by intermittently regulating the temperature of the intermediate fluid fed to the ambient air heater to a temperature greater than zero degrees Celsius using a source of supplemental heat, wherein the ambient air heater comprises a horizontal tube bundle and a vertical tube bundle, when a temperature of the intermediate fluid is above 0° C. the intermediate fluid is directed only through the horizontal tube bundle, and when the temperature of the intermediate fluid is less than or equal to 0° C. the intermediate fluid is directed through the vertical tube bundle.

2. The process of claim 1, wherein step (b) is conducted downstream of the ambient air heater.

3. The process of claim 1, wherein the source of supplemental heat is selected from the group consisting of an exhaust gas heater, an electric water or fluid heater, a propulsion unit of a ship, a diesel engine, a gas turbine propulsion plant, and an exhaust gas stream from a power generation plant.

4. The process of claim 1, wherein regasification of the LNG is conducted onboard an LNG carrier and the source of supplementary heat is heat recovered from the engines of the LNG carrier.

5. The process of claim 1, wherein heat exchange between the ambient air and the intermediate fluid in the ambient air heater is encouraged through use of forced draft fans.

6. The process of claim 1, wherein the intermediate fluid is selected from the group consisting of a glycol, a glycol-water mixture, methanol, propanol, propane, butane, ammonia, a formate, fresh water and tempered water.

7. The process of claim 1, wherein the intermediate fluid comprises a solution containing an alkali metal formate or an alkali metal acetate.

8. The process of claim 7, wherein the alkali metal formate is potassium formate, sodium formate or an aqueous solution of ammonium formate.

9. The process of claim 7, wherein the alkali metal acetate is potassium acetate or ammonium acetate.

10. The process of claim 1, wherein the ambient air heater is one of a plurality of ambient air heaters and step (b) is performed on each of the plurality of ambient air heaters sequentially.

11. The process of claim 1, wherein heat exchange between the ambient air and the intermediate fluid in the ambient air heater is encouraged through use of forced draft fans and the horizontal tube bundle lies above the vertical tube bundle in closer proximity to forced draft fans.

12. A regasification facility for regasification of LNG to form natural gas, said apparatus comprising:

a vaporizer for regasifying LNG to natural gas;

an ambient air heater for heating an intermediate fluid using ambient air as the primary source of heat;

a circulating pump for circulating the intermediate fluid between the vaporizer and the ambient air heater, the intermediate fluid being warmed by exchanging heat with the ambient air as the intermediate fluid passes through the ambient air heater, the intermediate fluid being cooled by exchanging heat with LNG as the intermediate fluid passes through the vaporizer; and a control device for regulating the temperature of the intermediate fluid fed to the ambient air heater to a temperature greater than zero degrees Celsius using a source of supplemental heat to subject the ambient air heater to a defrosting cycle, wherein the ambient air heater comprises a horizontal tube bundle and a vertical tube bundle, when a temperature of the intermediate fluid is above 0° C. the control device directs the intermediate fluid only through the horizontal tube bundle, and when the temperature of the intermediate fluid is less than or equal to 0° C. the control device directs the intermediate fluid through the vertical tube bundle.

13. The apparatus of claim 12, wherein the source of supplemental heat is located downstream of the ambient air heater.

14. The apparatus of claim 12, wherein the source of supplemental heat is selected from the group consisting of an exhaust gas heater, an electric water or fluid heater, a propulsion unit of a ship, a diesel engine, a gas turbine propulsion plant, and an exhaust gas stream from a power generation plant.

15. The apparatus of claim 12, wherein the regasification facility is provided onboard an LNG carrier and the source of supplementary heat is heat recovered from the engines of the LNG carrier.

16. The apparatus of claim 12, further comprising a forced draft fan for encouraging heat exchange between the ambient air and the intermediate fluid in the ambient air heater.

17. The apparatus of claim 12, wherein the ambient air heater is one of a plurality of ambient air heaters and the control device is arranged to subject each of the plurality of ambient air heaters sequentially to a defrosting cycle.

18. The apparatus of claim 12, wherein heat exchange between the ambient air and the intermediate fluid in the ambient air heater is encouraged through use of forced draft fans and the horizontal tube bundle lies above the vertical tube bundle in closer proximity to forced draft fans.

* * * * *